US011530105B2

(12) United States Patent
Girotto

(10) Patent No.: US 11,530,105 B2
(45) Date of Patent: Dec. 20, 2022

(54) BELT DRIVE UNIT FOR A MOLDING MACHINE OR BORED FINS, IN PARTICULAR FOR HEAT EXCHANGERS, WITH CONTROLLED ADAPTABILITY TO BORES OF DIFFERENT DIAMETERS

(71) Applicant: CEBI HI-TECH S.R.L., Cesano Maderno (IT)

(72) Inventor: Liviano Girotto, Cesano Maderno (IT)

(73) Assignee: CEBI HI-TECH S.R.L., Cesano Maderno (IT)

( * ) Notice: Subject to any disclaimer, the term of this patent is extended or adjusted under 35 U.S.C. 154(b) by 347 days.

(21) Appl. No.: 17/024,753

(22) Filed: Sep. 18, 2020

(65) Prior Publication Data

US 2021/0086252 A1 Mar. 25, 2021

(30) Foreign Application Priority Data

Sep. 19, 2019 (IT) ..... 102019000016766

(51) Int. Cl.
*B65H 20/22* (2006.01)

(52) U.S. Cl.
CPC ..... *B65H 20/22* (2013.01)

(58) Field of Classification Search
CPC ..... B65H 20/20; B65H 20/22; B21D 43/06
USPC ..... 83/423
See application file for complete search history.

(56) References Cited

U.S. PATENT DOCUMENTS

2012/0216664 A1 8/2012 Shiozawa et al.
2012/0272493 A1 11/2012 Morishita et al.

FOREIGN PATENT DOCUMENTS

EP 3031546 6/2016

OTHER PUBLICATIONS

Italian Search Report, dated May 28, 2020.

*Primary Examiner* — William E Dondero
(74) *Attorney, Agent, or Firm* — Jacobson Holman PLLC

(57) ABSTRACT

A drive unit (4) of the belt (3) for a molding machine (1) of bored fins comprises a fixed front part (12) and a movable rear part (13) driven longitudinally with a forward and backward movement to and from the fixed front part (12). Both parts (12, 13) of the drive unit (4) include support plates (16, 31) on the upper surfaces thereof for vertical teeth (20, 35) with oblique top (22, 37) which protrude upwards under elastic thrust (24, 39) and are suitable for being inserted into corresponding bored collars (52) of the belt (3) downstream of a boring unit (2). The upper surfaces of each of the two parts (12, 13) of the drive unit (4) support at least a further support plate (17, 32) for vertical teeth (21, 36) of greater diameter, which is liftable and lowerable by a control panel (50).

4 Claims, 13 Drawing Sheets

BELT DRIVE UNIT FOR A MOLDING MACHINE OR BORED FINS, IN PARTICULAR FOR HEAT EXCHANGERS, WITH CONTROLLED ADAPTABILITY TO BORES OF DIFFERENT DIAMETERS

BACKGROUND OF THE INVENTION

The present invention relates to a belt drive unit for a molding machine of bored fins, in particular for heat exchangers, with controlled adaptability to bores of different diameters.

Molding machines for bored fins for heat exchangers are known particularly from US 2012/216664 A1, in which a metal belt is moved forward into the machine, where there is a boring unit which provides for making bores in pre-established areas of the metal belt, previously drawn, to obtain bored collars intended for the passage of the heat exchanger tubes. At the exit of the molding machine, a cutting unit is provided, which carries out transverse cutting operations of the belt to divide the belt itself into single bored fins.

To allow the sequential execution of the various drawing, molding and cutting operations, and possibly others, the metal belt is moved forward stepwise with forward movement pauses corresponding to the positioning of predetermined areas of the belt first inside the drawing unit, then inside the boring unit and finally at the cutting unit.

The forward movement of the belt is carried out by a drive unit with alternating forward and backward movement, which is provided between the boring unit and the cutting unit with the task of dragging the bored belt forwards, positioning it appropriately and then leaving it in the position reached, which is suitable for cutting it by means of a cutter, finally returning to a suitable position for the next driving operation.

For this purpose, the drive unit usually comprises a fixed front part and a movable rear part driven longitudinally with a forward and backward movement to and from the fixed front part. Both parts of the drive unit include support plates on the upper surfaces thereof for vertical teeth with movable oblique top which protrude upwards under elastic thrust and are suitable for being inserted into corresponding bored collars of the belt downstream of a boring unit. The teeth of the movable rear part drive the belt forward during the forward movement of said movable rear part to then lower it below the plane of the belt and leave it in the position reached during the next backward movement of the same movable rear part, while the teeth of the fixed front part keep the belt in the position reached, which is suitable for the next cutting operation, during the step of moving backward the movable rear part.

This mode of operating the drive unit is fully satisfactory as long as the diameter of the bored collars of the fins remains constant. The problem arises when the same machine is used for molding belts and consequent fins with bored collars of larger diameter. In this case, the same teeth for moving forward and positioning the belt are obviously not usable in combination with larger collars. It is then necessary to modify the drive unit so as to allow it to use plates with teeth of correspondingly increased diameter. This currently requires the intervention of specialized operators who perform the partial or total removal and replacement of the plates with teeth. A similar intervention is necessary for the transition from a belt with bored collars of larger diameter to a belt with bored collars of a smaller diameter, which are obviously not able to receive teeth intended for larger bored collars.

SUMMARY OF THE INVENTION

Faced with this problem, it was the object of the present invention to facilitate, speed up and associate with a simple command the passage of the machine from molding fins with smaller diameter bores to molding fins with larger diameter bores, and vice versa, while avoiding complex replacement or movement maneuvers to be performed directly on the drive unit.

According to the present invention, this object is achieved by providing the upper surfaces of each of the two movable and fixed parts of the drive unit with at least a further support plate for movable vertical teeth with oblique top of larger diameter, which is liftable and lowerable by a control panel compared to that with smaller diameter teeth to replace the teeth thereof with those previously used for moving forward and positioning the belt.

Thereby, the operating passage from obtaining fins with small diameter bores to obtaining fins with larger diameter bores, or vice versa, can occur by producing with a simple command the lifting or lowering, respectively, of the plates with teeth of greater diameter above or below the operating plane of the plates with small diameter teeth, respectively. The intervention of toolmakers is not necessary, because an external command given by the operator responsible for controlling the machine is sufficient.

DESCRIPTION OF THE DRAWINGS

The features and advantages of the present invention will become apparent from the following detailed description of a possible embodiment thereof, shown by way of non-limiting example in the accompanying drawings, in which.

DETAILED DESCRIPTION OF THE INVENTION

Figure 1:
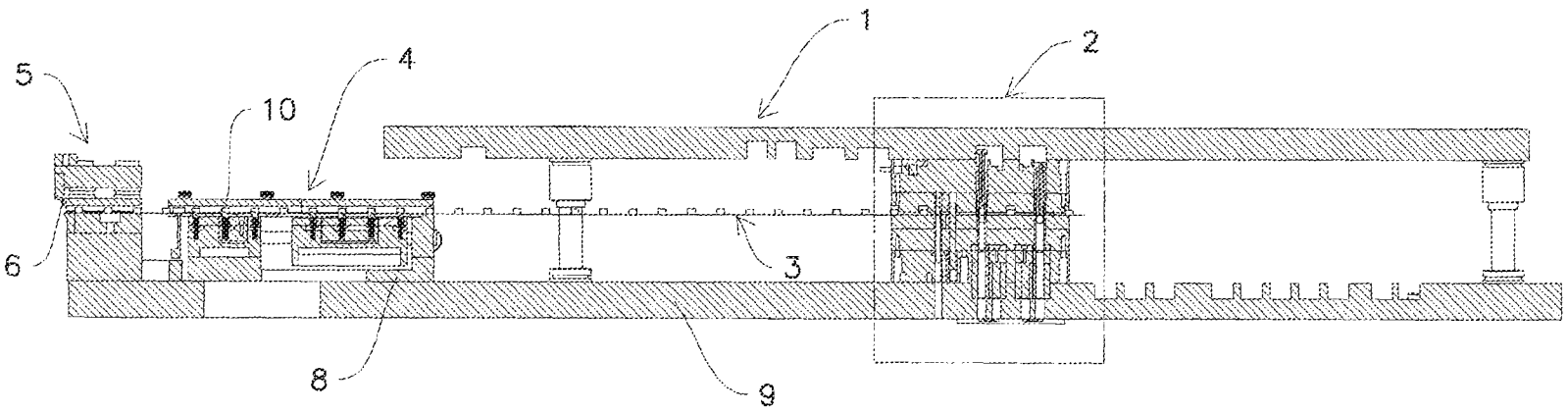
FIG. 1 shows a longitudinal section of a machine for molding bored fins which uses a drive unit according to the present invention.

With reference to FIG. 1, a molding machine 1 for bored fins, in particular for heat exchangers, comprises a boring unit 2 preceded and followed by other operating units not shown here for simplicity, such as for example a drawing unit provided upstream of the boring unit in the forward direction F of a metal belt 3 to be drawn and bored.

The molding machine includes, at the exit thereof, a drive unit 4 for the belt 3 and a cutting unit 5 which, by means of a cutter 6, divides the belt 3 into a plurality of single bored fins intended for the formation of heat exchangers or other.

Figure 6:
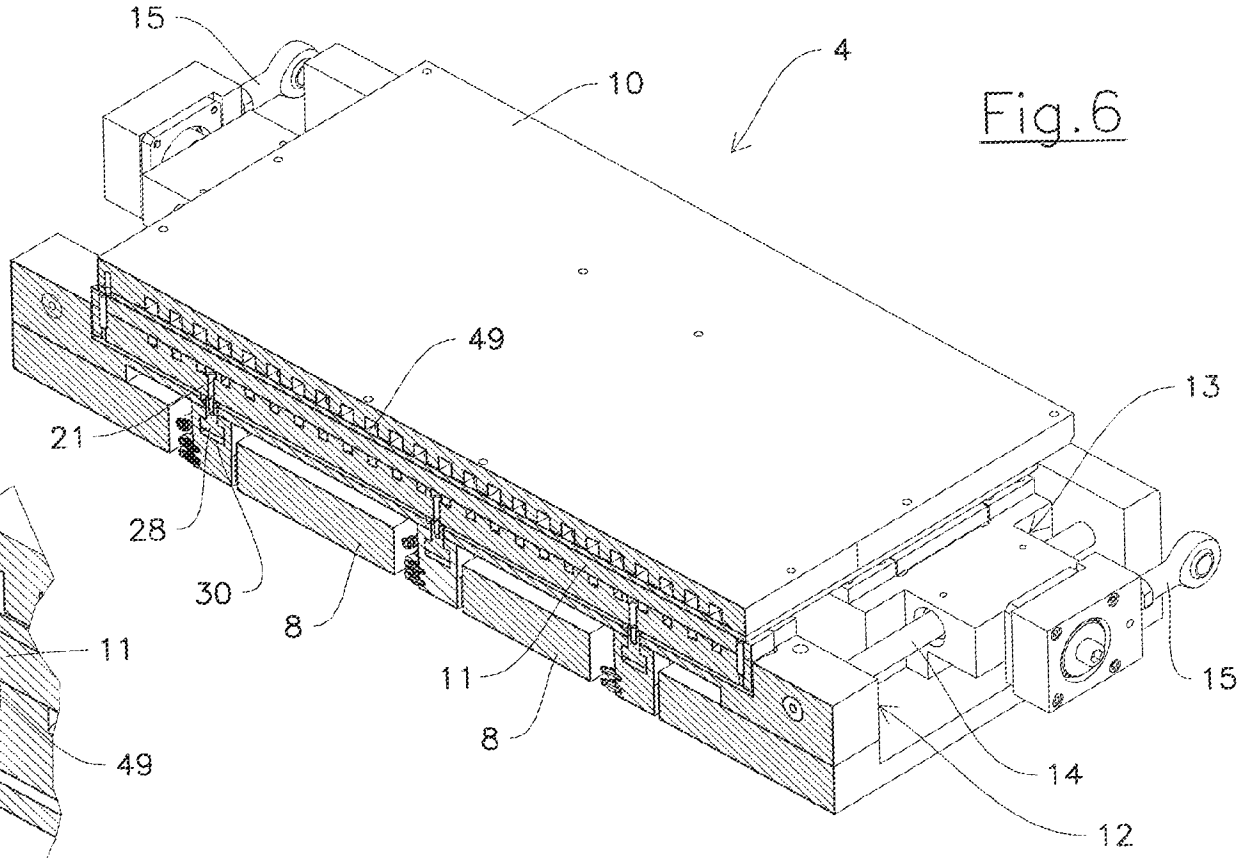
FIG. 6 shows a partially sectioned perspective view of a base similar to that in FIGS. 3 and 5 with the cover applied.
Figure 7:
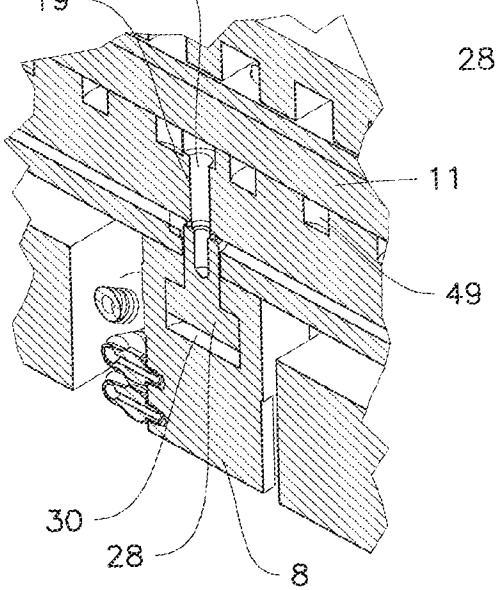
FIG. 7 shows a constructional detail of the base in FIG. 6 on an enlarged scale.

The drive unit 4, which forms the object of the present invention, can be of various shapes and sizes but essentially comprises a fixed base 8, in turn fixed to the general base 9 of the molding machine, and an openable cover 10, as shown in FIG. 6.

Figure 2:
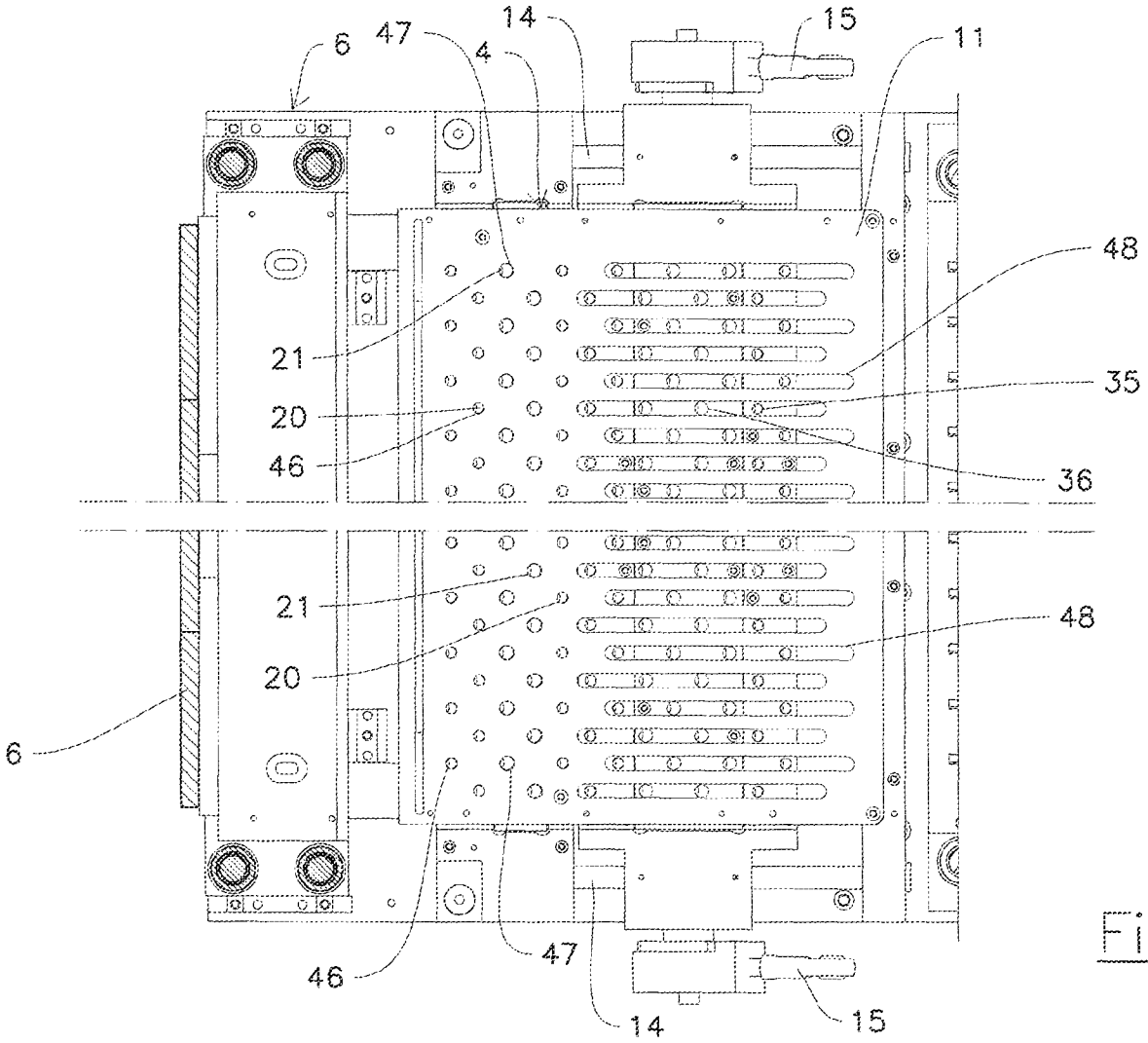
FIG. 2 shows an enlarged plan view of the base, without the cover, of the drive unit in FIG. 1.
Figure 3:
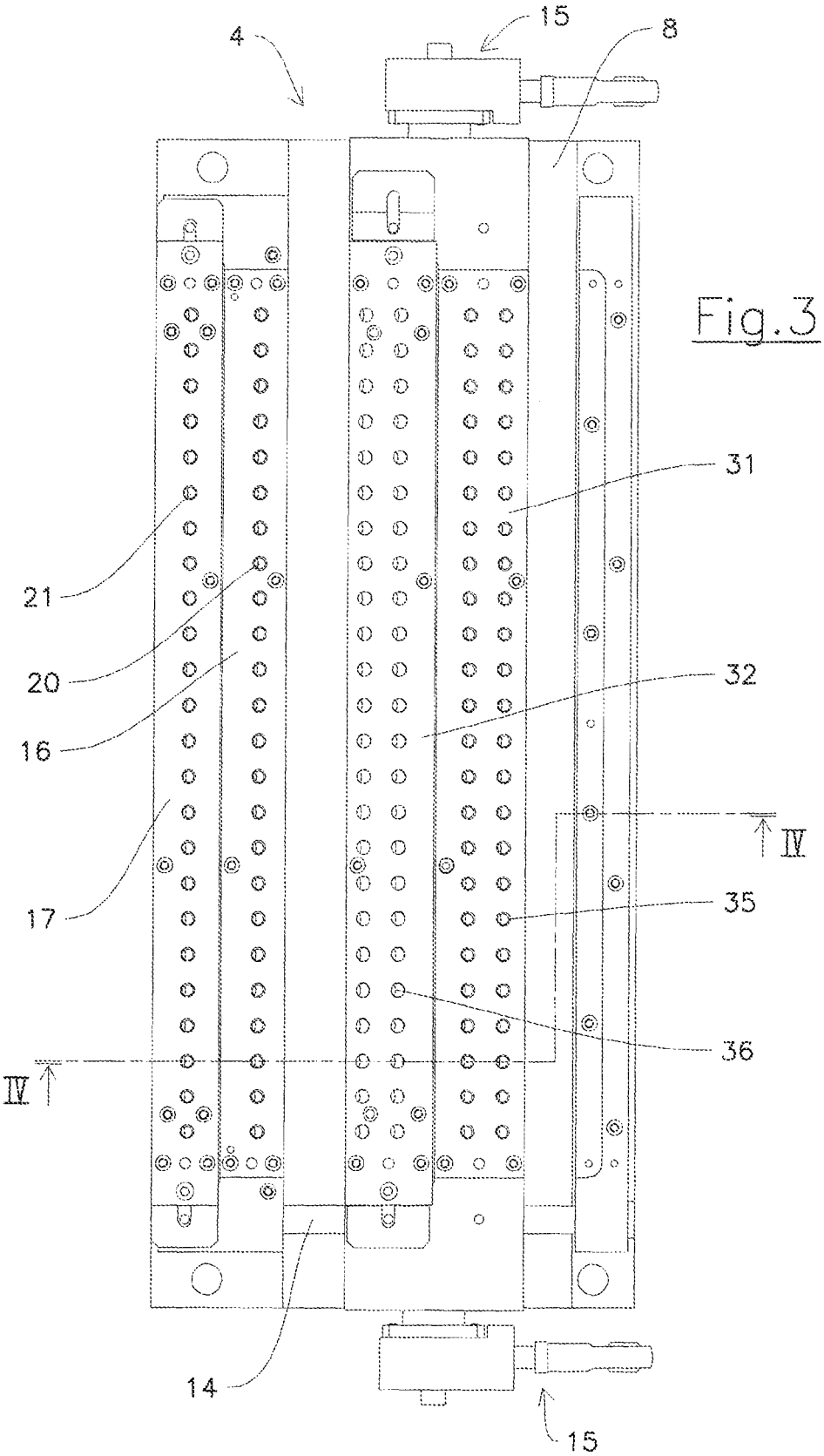
FIG. 3 shows a further plan view of a specific example of the base of the drive unit, again without a cover.
Figure 4:
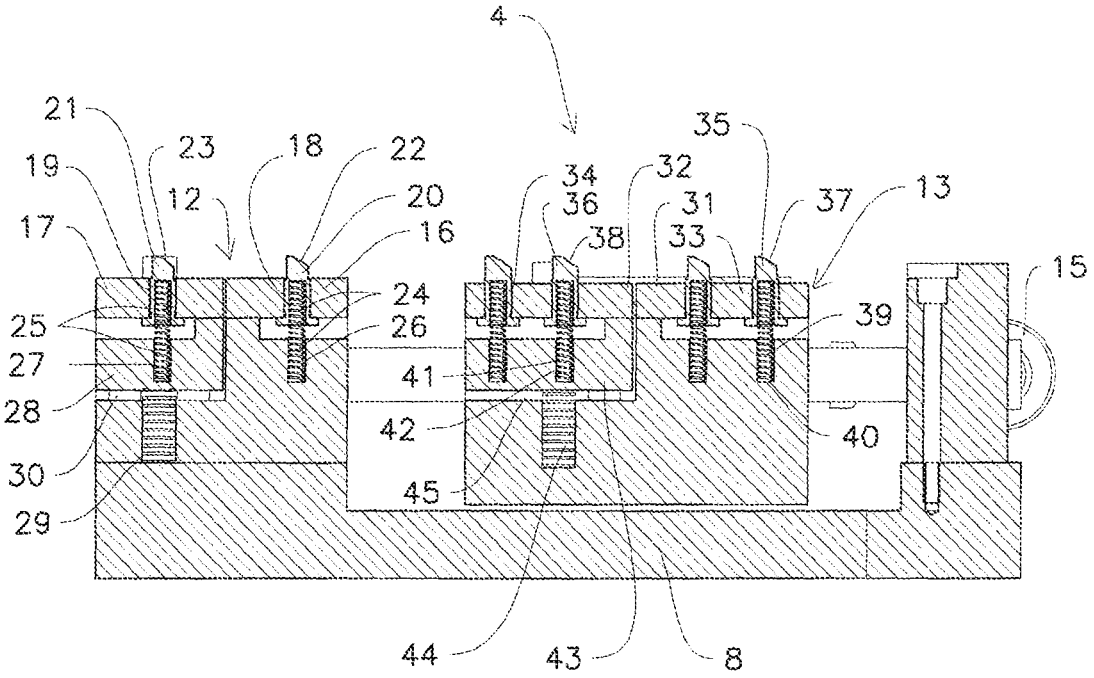
FIG. 4 shows a sectional view along line IV-IV of the base in FIG. 3.
Figure 5:
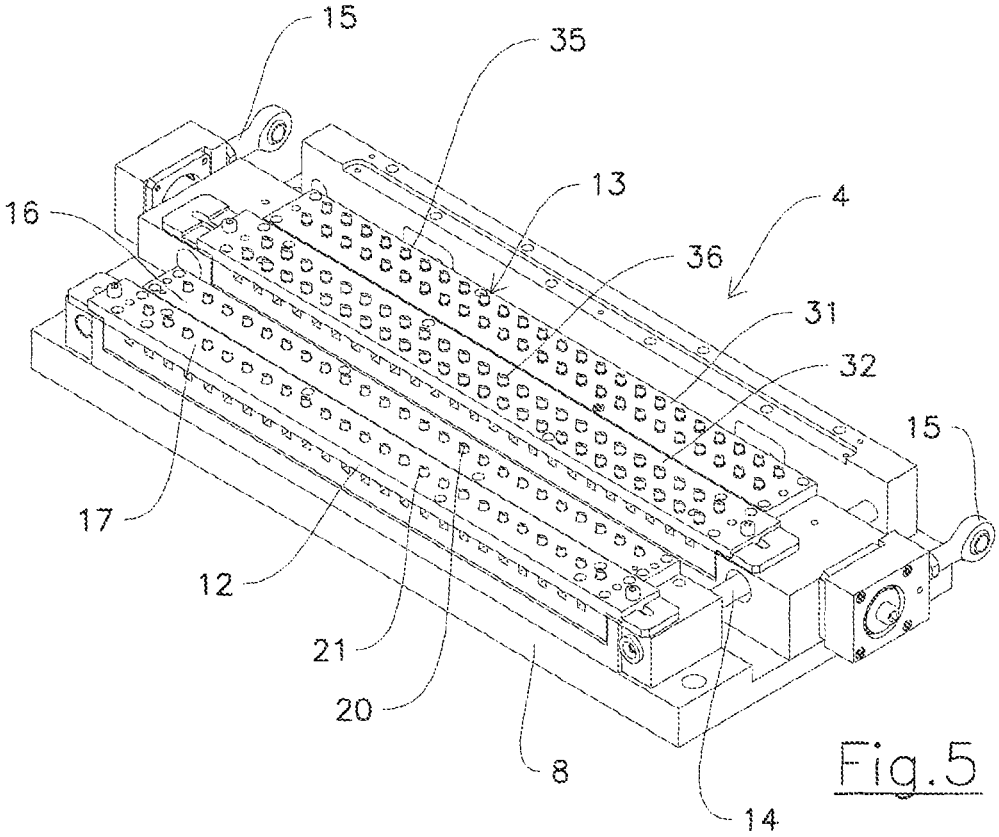
FIG. 5 shows a perspective view of the same base in FIG. 3.

Exemplary forms of the base 8 of the drive unit 4 are shown in FIGS. 2-5 and include a flat upper plate 11 below intended to support the belt 3, shown in FIG. 2, a fixed front part 12 and a rear part 13 movable longitudinally forward and backward along guides 14 parallel to the forward direction of the belt 3 and under the control of motorized crank mechanisms 15 (FIGS. 4-6).

As shown in FIGS. 3-6 and 8-15, the upper surface of the fixed front part 12 includes plates 16 and 17 placed side by side with respect to the forward direction of the belt 3, which support respective cylindrical vertical teeth 20 and 21 with oblique top 22 and 23, which are slidably housed in respective cylindrical vertical bores 18 and 19 of the support plates 16 and 17 and pushed upwards by respective springs 24 and 25. The teeth 20 are relatively smaller in diameter and have the respective reactant springs 24 thereof inside cavities 26 of the fixed front part 12. Instead, the teeth 21 have a relatively larger diameter and have the relative reactant springs 25 inside cavities 27 of an intermediate plate 28 integral with the upper plate 16 and movable upwards therewith, against the action of a retaining spring 29, by introducing fluid into an underlying compartment 30.

In a completely similar manner, the upper surface of the movable rear part 13 includes plates 31 and 32 side by side with respect to the forward direction of the belt 3, which support respective cylindrical vertical teeth 35 and 36 with oblique tops 37 and 38, identical to the teeth 20 and 21 of the fixed front part 12, which teeth 35 and 36 are slidably housed in respective cylindrical vertical bores 33 and 34 of the support plates 31 and 32. The teeth 35 are pushed upwards by respective reactant springs 39 inside cavities 40 of the movable rear part 13, while the teeth 36 are pushed upwards by reactant springs 41 inside cavities 42 of an intermediate plate 43 integral with the upper plate 17 and movable upwards therewith, against the action of a retaining spring 44, by introducing fluid into an underlying compartment 45.

The teeth 20 and 21 also pass through respective circular bores 46 and 47 of the upper flat plate 11, while the teeth 35 and 36 are housed in a longitudinally sliding manner inside elongated slots 48 which extend in the longitudinal direction defined by the forward direction F of the belt 3.

Longitudinal channels 49 are provided in the lower surface of the cover 10 to accommodate and delimit the vertical lifting of the teeth 21, 22, 35, 36 during the driving and positioning operation.

Figure 16:
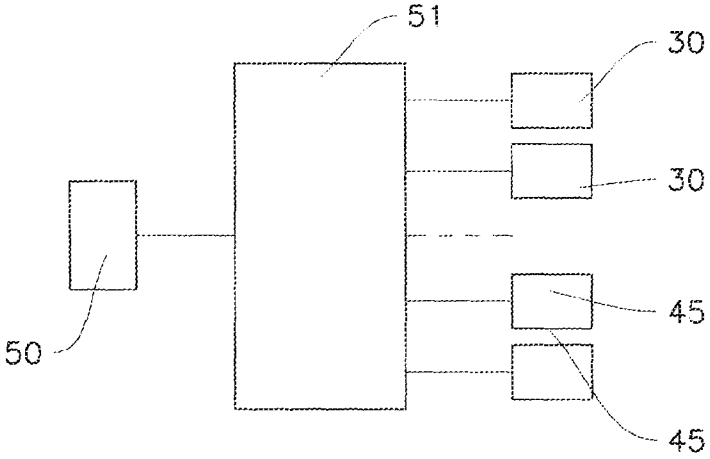
FIG. 16 shows the basic diagram of a remote control system associated with the drive unit for switching it from driving a belt with smaller diameter bores to driving a belt with larger diameter bores, and vice versa.

Finally, a remote control system is associated with the drive unit 4, the main diagram of which is shown in FIG. 16 and comprises a control panel 50 conveniently positioned with respect to the machine and a control unit 51 which sends commands (essentially, pressurized fluid) to the compartments 30 and 45 of the drive unit for switching it from driving a belt with smaller diameter bores to driving a belt with greater diameter bores, and vice versa.

The structure described above gives rise to the following operating method of the drive unit 4 and more generally of the molding machine which comprises it.

A metal belt 3 exits the boring unit 2 provided with bored collars 52 which are arranged according to the positioning diagram of the teeth 21, 22, 35, 36 of the drive unit 4 and have a diameter which can be varied between two predetermined values (referred to here as "smaller diameter" and "greater diameter") by conveniently acting, in a known manner, on the boring unit 2 and possibly on the drawing unit which precedes it. As the aforesaid diameter varies, it is necessary to act on the drive unit 4 in a corresponding manner. The control system in FIG. 16 is provided for this purpose, which operates as follows.

Figure 8:
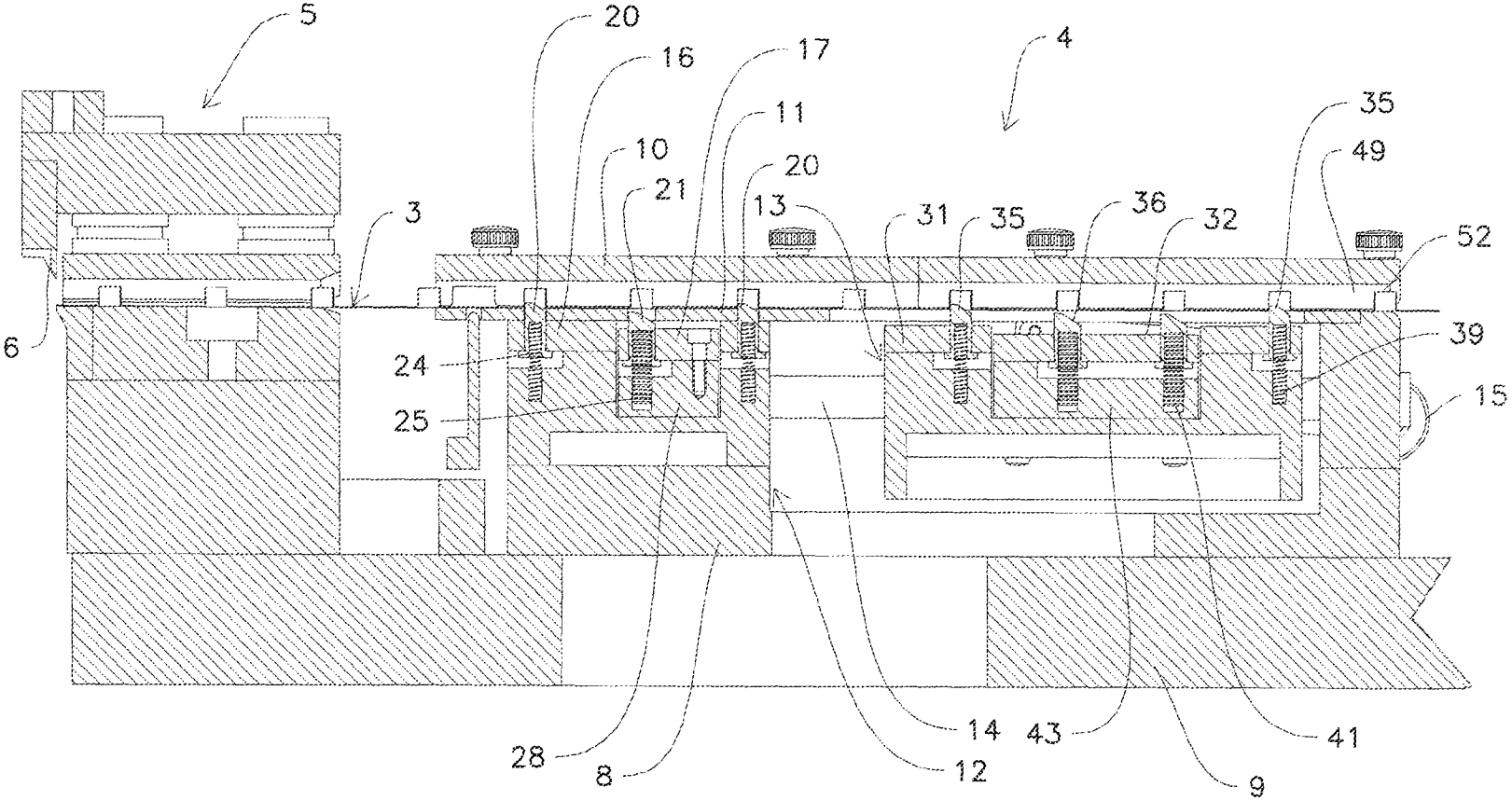
FIG. 8 shows a longitudinal section view of an example of a drive unit with the movable rear part thereof in the backward position, ready for driving a belt with smaller diameter bores.
Figure 9:
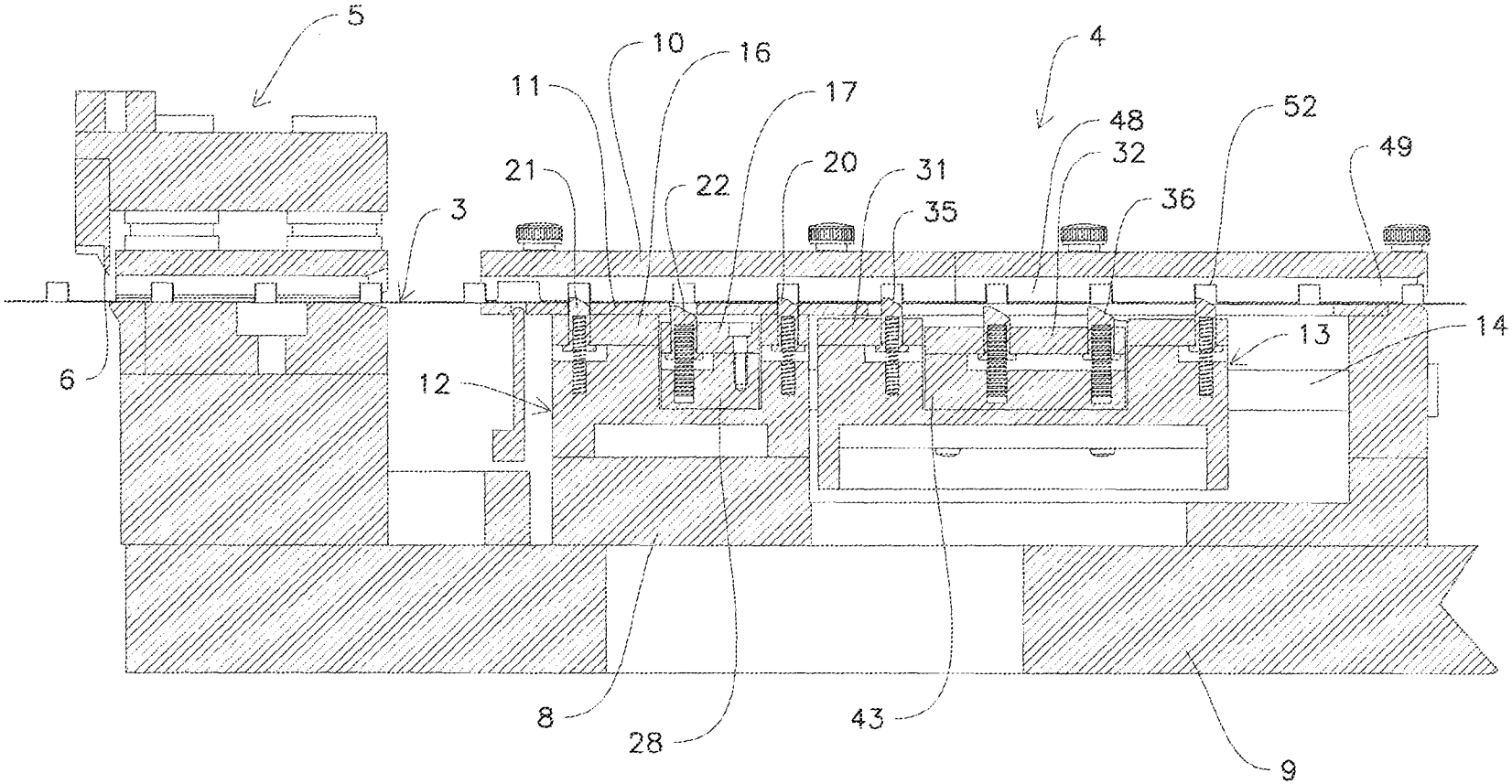
FIG. 9 shows a longitudinal sectional view of the same drive unit with the movable rear part thereof in the forward position after moving forward a belt with smaller diameter bores.
Figure 10:
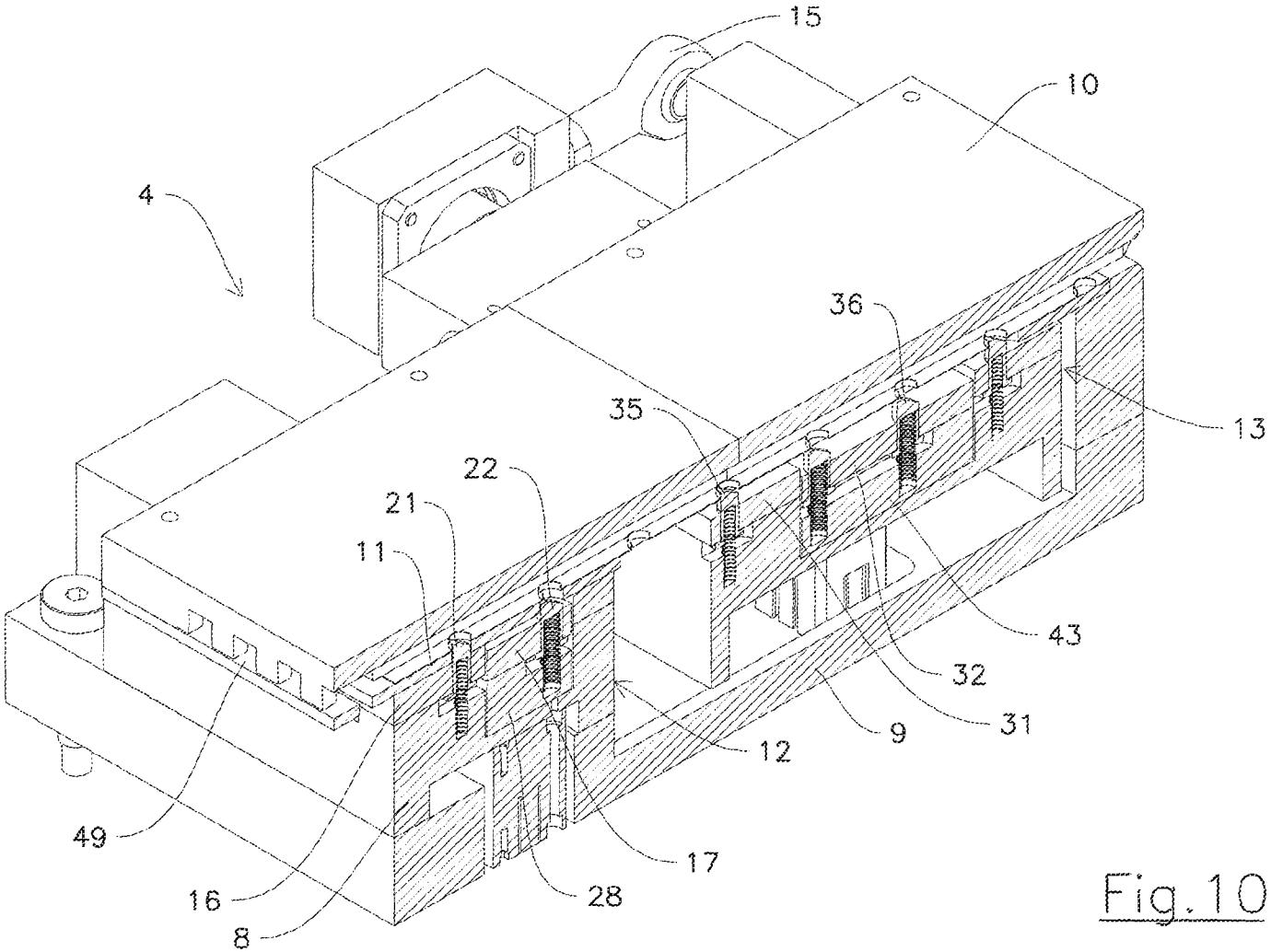
FIGS. 10 and 11 show perspective views of the drive unit in the positions in FIGS. 8 and 9, respectively.
Figure 11:
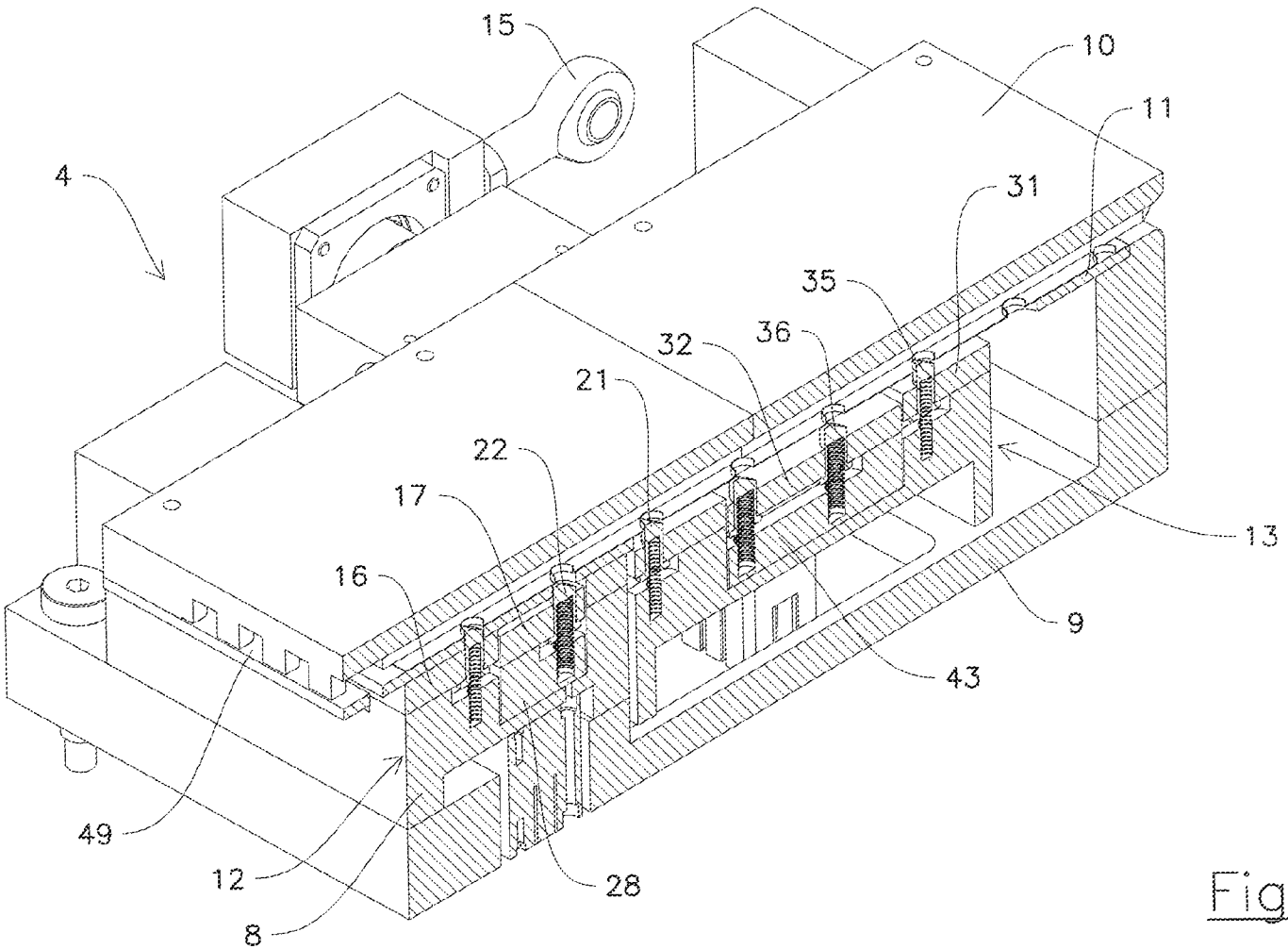
Figure 12:
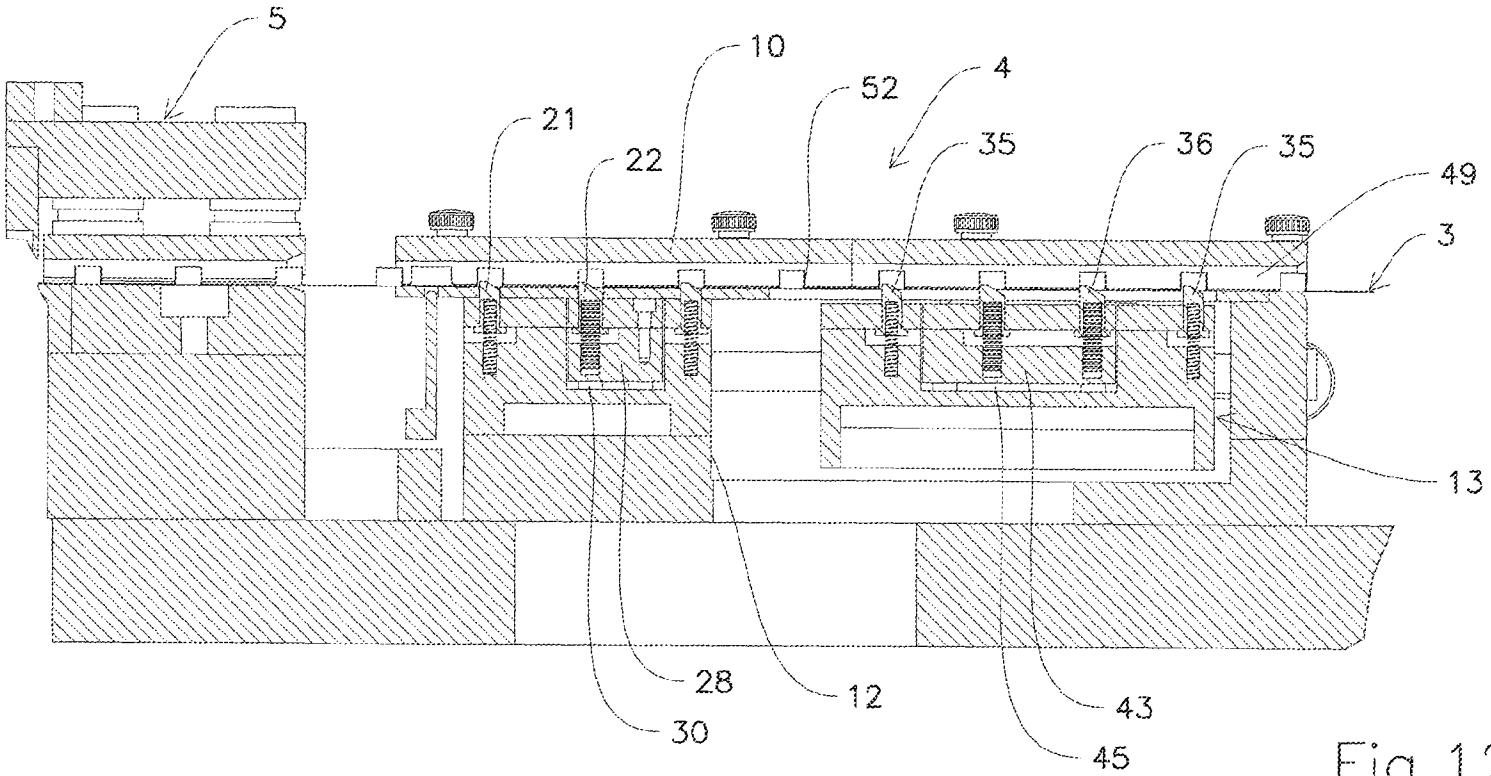
FIG. 12 shows the enlarged assembly of the drive unit with the movable rear part thereof in the backward position, ready for driving a belt with greater diameter bores.
Figure 13:
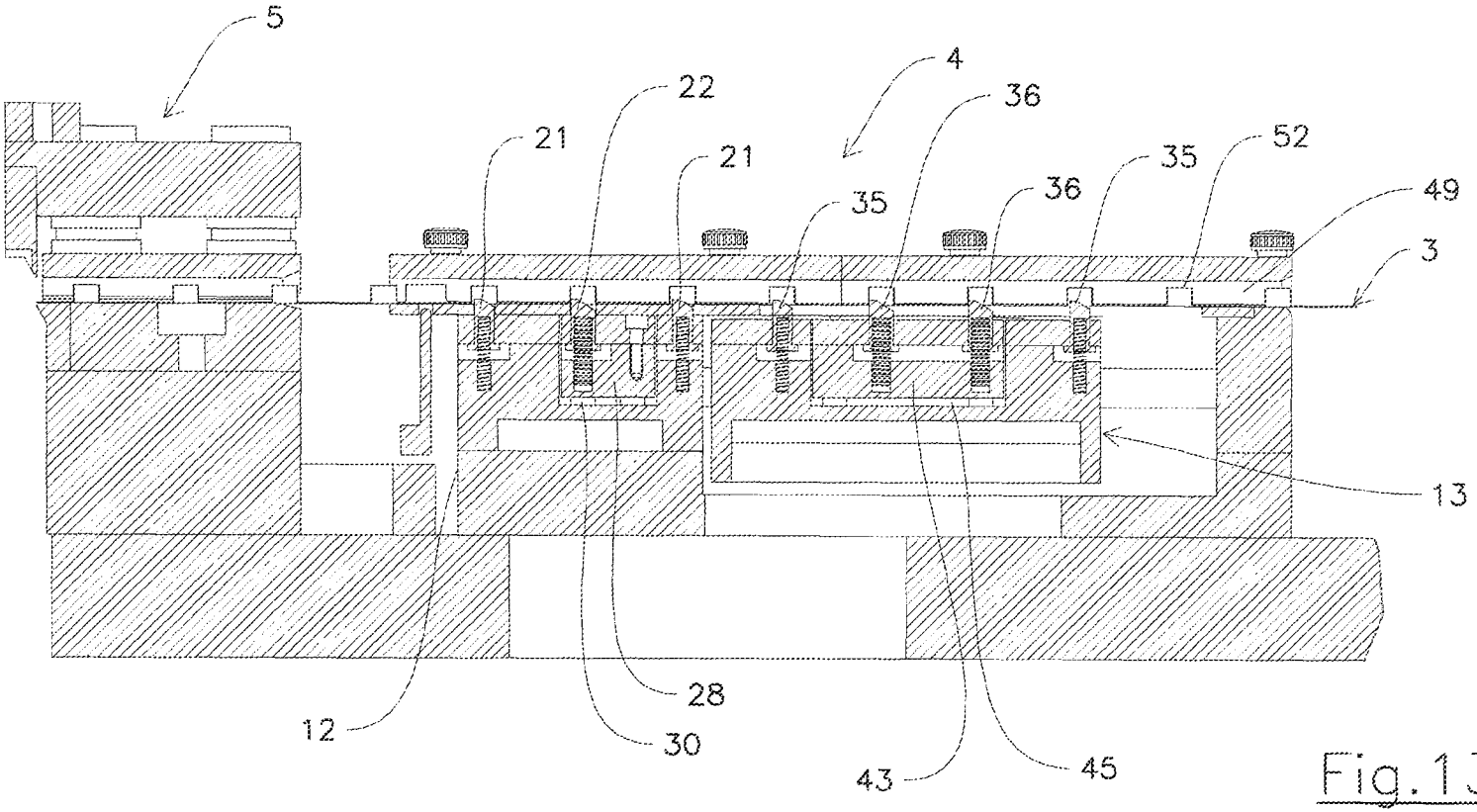
FIG. 13 shows the enlarged assembly of the drive unit with the movable rear part thereof in a forward position after driving a belt with greater diameter bores.
Figure 14:
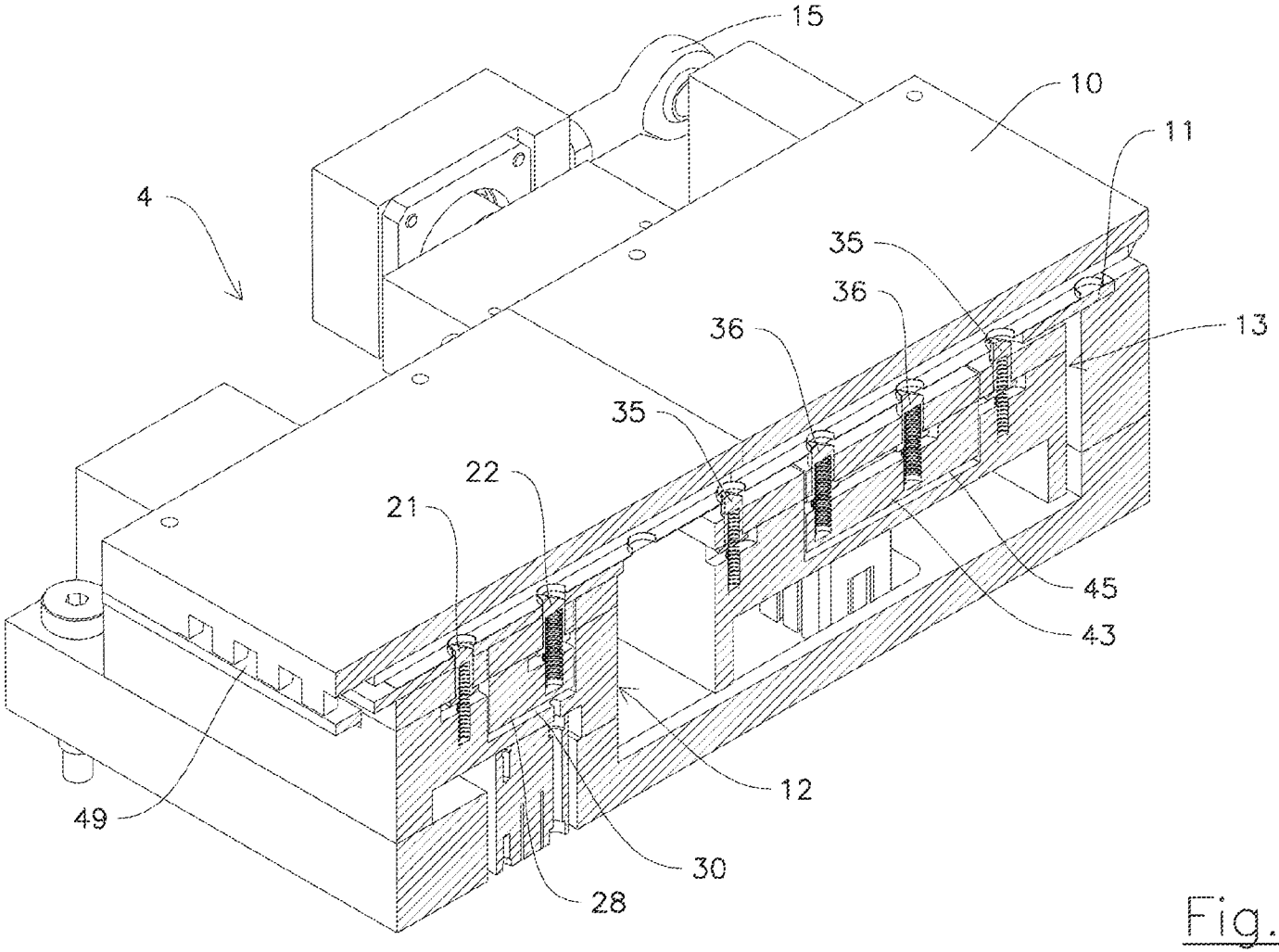
FIGS. 14 and 15 show enlarged details of the drive unit in the positions in FIGS. 12 and 13, respectively.
Figure 15:
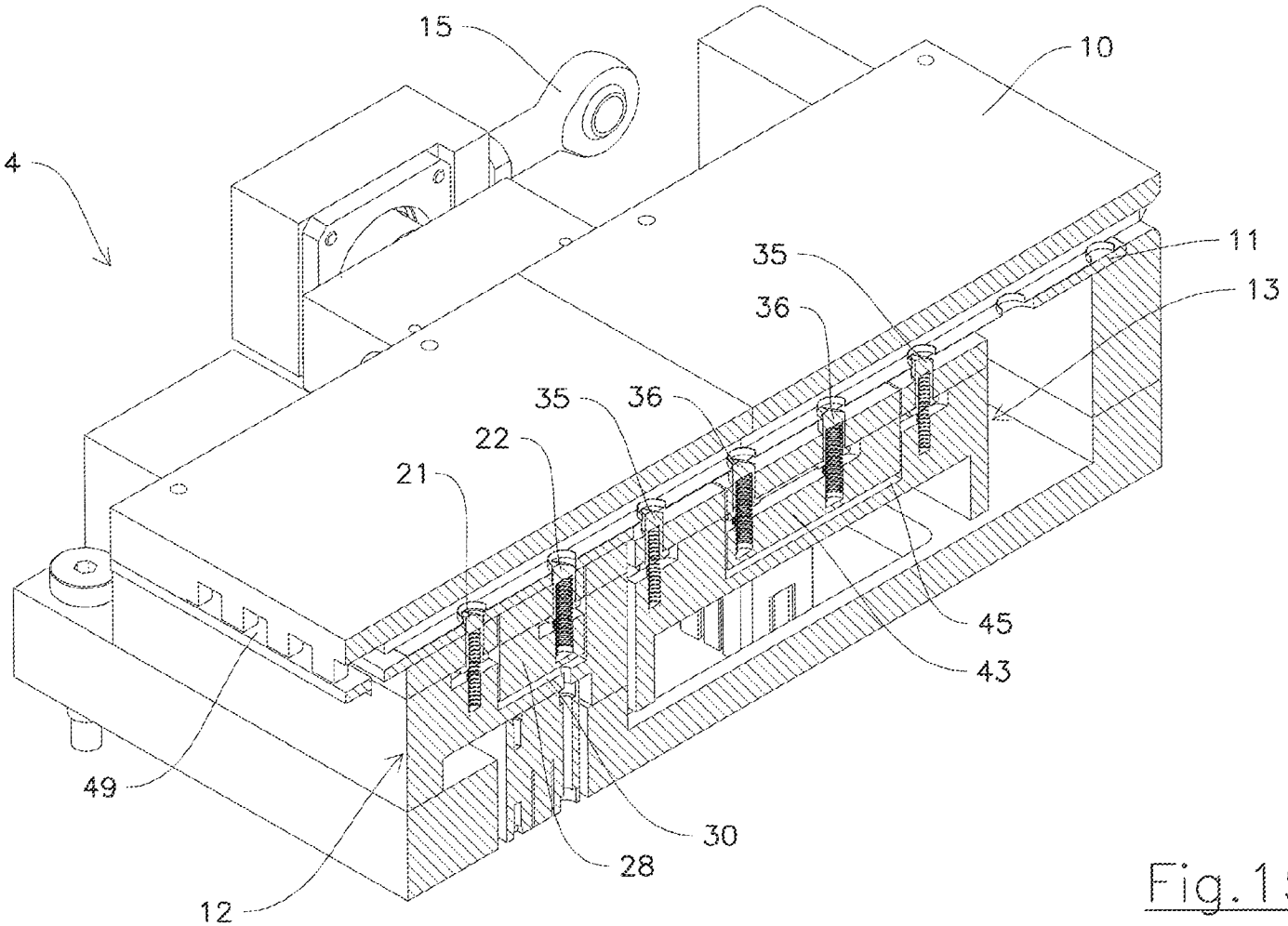

If the belt 3 has been bored with smaller diameter bores, the smaller teeth 35 of the movable rear part 13 of the drive unit carry out the dragging of the belt, which are inserted into the bored collars 52 of the belt when in a backward position as in FIGS. 8 and 10 and, due to the action of the crank mechanisms 15, drag them longitudinally towards the forward position in FIGS. 9 and 11, sliding along the slots 48 in FIG. 2. Once the belt has been brought into this position, the teeth 21 of the fixed front part 12 of the drive unit are in turn inserted into the bored collars of the belt and hold the aforesaid collars in position and therefore the belt as a whole, while the movable rear part 13 is returned to the position in FIGS. 8 and 10 by the crank mechanisms 15 making the teeth 35 slide along the slots 48, which retract downwards, against the action of the springs 39, exploiting for this purpose the thrust exerted by the rear walls of the belt 3 collars on the oblique tops 37 of the teeth 35.

During this operation, carried out repeatedly to move forward the belt 3 step by step and bring subsequent portions of the belt itself to the cutting unit for the subdivision into single bored fins, the operator of the machine kept the control panel 50 in condition such as to remove the operating fluid from the compartments 30 and 45 and allow the springs 29 and 44 in FIG. 4 to hold the intermediate plates 28 and 43 in the lowered position and therewith the teeth 22 and 36 of greater diameter, so that these do not interfere with the feeding motion of the belt.

If the machine is switched so as to bore the belt with larger diameter bores, the operator can easily switch the drive unit 4 accordingly, by acting on the control panel 50 so as to command the control unit 51 to introduce pressurized fluid into the compartments 30 and 45 to bring the intermediate plates 28 and 43 into the lifted position and therewith the teeth 22 and 36 of greater diameter, which can thus be inserted into the bores of the belt to cause the repeated forward movement of the belt step by step in the same manner as already described for the case of smaller diameter bores.

In a similar manner, by unloading the pressurized fluid from the compartments 30 and 45 by a command given by the operator to the control panel 50, it is possible to return the drive unit to the operating condition for the belt with smaller diameter bores.

The operator only has to act conveniently on the control panel 50 without carrying out operations of assembling or disassembling parts of the drive unit.

The invention claimed is:

1. A drive unit of a belt for a molding machine for bored fins, for heat exchangers, comprising a fixed front part and a movable rear part driven longitudinally with a forward and backward movement to and from the fixed front part, wherein both parts of the drive unit include, on upper surfaces thereof, support plates for movable vertical teeth with oblique top which protrude upwards under elastic thrust and are suitable for being inserted into corresponding bored collars of the belt downstream of a boring unit of the molding machine, wherein the vertical teeth of a movable rear part drive the belt forward during the forward movement of the movable rear part and then lower below the plane of the belt to leave the belt in the position reached during a next backward movement of the movable rear part, while the vertical teeth of the fixed front part keep the belt in the position reached, which is suitable for a next cutting operation, during the step of moving the movable rear part backward, the improvement comprising that the upper surfaces of each of two movable and fixed parts of the drive unit support at least a further support plate for movable further vertical teeth with an oblique top of greater diameter, which are liftable and lowerable by a control panel and the vertical teeth of smaller diameter are replaced with the further vertical teeth.

2. The drive unit according to claim 1, wherein the further support plate for the further vertical teeth of greater diameter is supported by an intermediate plate elastically retained in a lowered position and movable to a lifted position by the control panel.

3. The drive unit according to claim 2, wherein the intermediate plate is movable to a raised position by introducing pressurized fluid into a compartment underlying the intermediate plate.

4. The drive unit according to claim 3, wherein the intermediate plate can be returned to the lowered position by unloading the pressurized fluid from the compartment underlying the intermediate plate.

* * * * *